United States Patent [19]

Torassa et al.

[11] 4,203,529

[45] May 20, 1980

[54] POURING RECEPTACLE WITH AUTOMATIC CLOSURE

[76] Inventors: Jean F. Torassa; Gerard Torassa, both of Les Residences du mont Boron 31 avenue de Mont Boron, 06300 Nice, France

[21] Appl. No.: 950,396

[22] Filed: Oct. 11, 1978

[51] Int. Cl.[2] ..... B65D 43/14; B65D 51/04

[52] U.S. Cl. ..... 220/337; 220/338; 220/264; 220/334

[58] Field of Search ..... 220/254, 281, 334, 337, 220/338, 263, 264; 222/556, 473, 474, 425

[56] References Cited

U.S. PATENT DOCUMENTS

| | | | |
|---|---|---|---|
| 2,483,304 | 9/1949 | Vogel | 220/264 X |
| 3,964,609 | 6/1976 | Perrella | 220/338 X |

*Primary Examiner*—George T. Hall
*Attorney, Agent, or Firm*—Young & Thompson

[57] ABSTRACT

A pouring receptacle has a closure that can be pressed open and which is resiliently returned to closed position when pressure is released. The receptacle proper has diametrically opposed upwardly open slots with enlargements at their lower ends, the enlargements receiving bosses on the cover and the slots receiving elongated lugs on the cover in the closed position of the cover. The material of the cover or receptacle proper is resilient, so that when the cover is pressed, it will swing about the bosses and the lugs and/or side walls of the slots will resiliently deform sufficiently to permit opening, this resilient deformation serving to urge the cover to the closed position upon release of pressure.

9 Claims, 5 Drawing Figures

POURING RECEPTACLE WITH AUTOMATIC CLOSURE

The present invention relates to pouring receptacles of the type in which the cover may be swung open but is resiliently returned to closed position upon the release of pressure.

Such pouring receptacles are already known, comprising a casing having a cover on which the user may press to swing the cover to open position, the cover being returned to closed position by one or more springs upon the release of pressure.

However, the known receptacles are relatively complicated and expensive and unreliable by virtue of their springs.

Accordingly, it is an object of the present invention to provide such a pouring receptacle which avoids the drawbacks of those already known.

Briefly, the present invention achieves this object by providing a pouring receptacle with an automatically returned closure, whose automatic return is effected without the aid of a spring, but rather by the natural elasticity of one or both of the relatively movable parts of the structure.

In more detail, the present invention comprises a casing that has diametrically opposed slots that open upwardly through its upper edge, the lower ends of the slots comprising circular enlargements. A swinging cover is provided which has two vertically elongated lugs of a size to fit in the slots, the lugs terminating downwardly in knobs or bosses that project into the rounded enlargements at the lower ends of the slots and which provide a hinge about which the cover swings on and relative to the casing. When one presses against the cover to swing it from its closed position to its open position, the lugs tend to swing out of the slots; and to accommodate this displacement of the parts, either the lugs or the side walls of the slots or both are sufficiently resilient to permit the lugs to slide with a cam action on the inner sides of the borders of the slots. Upon the release of pressure on the cover, this elasticity exerts a cam action in the opposite direction, to cause the camming surfaces to slide against each other and the cover to swing back to closed position in which the lugs return to their rest position in the slots.

Other objects, features and advantages of the present invention will become apparent from a consideration of the following description, taken in connection with the accompanying drawing, in which.

Figure 1:
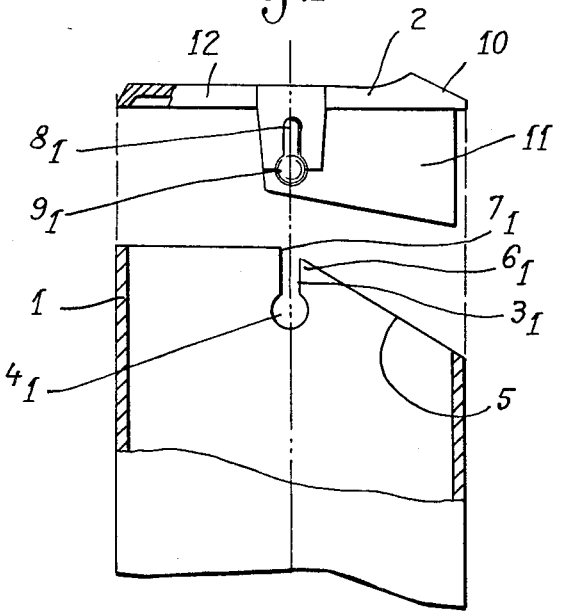
FIG. 1 is an exploded assembly view, partly in cross section, of a first embodiment of pouring receptacle according to the present invention.

Referring now to the drawing in greater detail, and first to the embodiment of FIGS. 1–4, it will be seen that there is provided a pouring receptacle according to the present invention comprising broadly a casing 1 and a cover 2.

The casing comprises two diametrically opposed slots $3_1$ which are vertically disposed and open upwardly through the upper edge of casing 1. At their lower ends, slots $3_1$ terminate in circular enlargements $4_1$. The upper edge of the rear portion of the casing 1 is cut away on the bias at 5, so that the upper edge of this portion of the casing forms with the slots $3_1$ two acute-angled beaks $6_1$ and $6_2$ whose height is slightly less than that of the right-angled beaks $7_1$ on the other side of the slots.

The cover 2 comprises two diametrically opposed elongated lugs $8_1$ and $8_2$ which are vertically disposed in the closed position of cover 2 and that terminate downwardly in projecting rounded knobs or bosses $9_1$ and $9_2$.

Cover 2 also comprises a finger piece 10 and a downwardly depending guide skirt 11.

Figure 2:
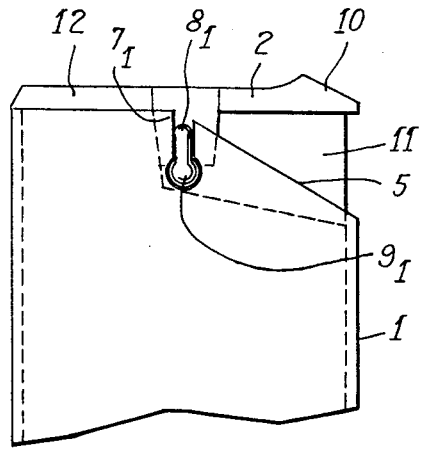
FIG. 2 is a side elevational view of the same structure as in FIG. 1, with the parts in assembled relationship and the cover closed.

FIG. 2 shows the cover 2 in closed position on casing 1. The lugs $8_1$, $8_2$ of the cover are parallel with and engaged in their respective slots $3_1$ of the casing, the bosses $9_1$ and $9_2$ being disposed in their respective circular enlargements $4_1$ and serving as hinge pins permitting the swinging of the cover on and relative to the casing.

Figure 3:
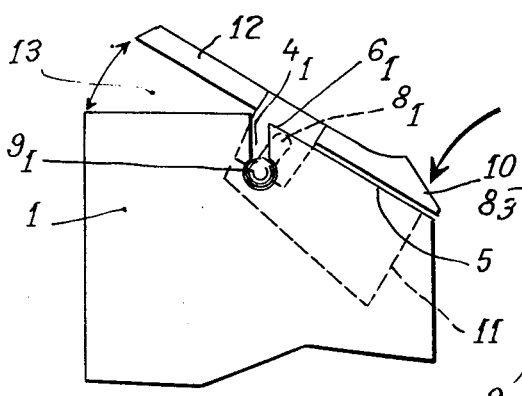
FIG. 3 is a view similar to FIG. 2 but showing the cover pressed open.
Figure 4:
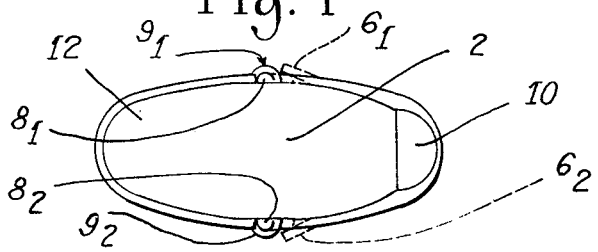
FIG. 4 is a top plan view of FIG. 2 showing the closed position of the parts in full line and the FIG. 3 position of the lugs and their adjacent structure in phantom line.

FIGS. 3 and 4 show the receptacle in open position when the user presses on the finger piece 10 of cover 2.

The bosses $9_1$ and $9_2$ then turn in their enlargements $4_1$ and the skirt 11 of the cover swings down into the interior of the casing until the lower edge of the cover comes into abutment against the edges of the cutaway portion 5 of the casing, which limits the swinging movement of the cover. At the same time, of course, the forward portion 12 of the cover, which serves as a cap or lid, swings away from the upper edge of the casing, thus exposing an opening 13 permitting the contents of the casing to be poured out.

Moreover, the lugs $8_1$ and $8_2$ swing toward the rear with the cover on which they are mounted and move into position in the interior of the casing, inwardly of the two beaks $6_1$ and $6_2$ between which they are disposed. For this purpose, therefore, it will be understood that the material of the casing 1, at least in the region of the beaks $6_1$ and $6_2$, is sufficiently resilient to permit this, and may for this purpose comprise, for example, synthetic resin.

The position of the parts shown in FIGS. 3 and 4 will be maintained as long as the user continues to apply pressure on the finger piece 10.

When this pressure is released, the resiliency of the beaks $6_1$ and $6_2$ presses the lugs $8_1$ and $8_2$ with a camming action, to return them to their initial position in the slots $3_1$, which automatically causes the cover to swing back to closed position.

Of course, the casing 1 can have any desired cross-sectional configuration, such as round, oval, rectangular, square, etc.

Moreover, the pouring receptacle of the present invention can have any desired usage, for pouring or dispensing of articles such as lozenges, candies, pills, pieces of spice, etc., or pulverulent material such as salt, pepper, sugar, etc.

Figure 5:
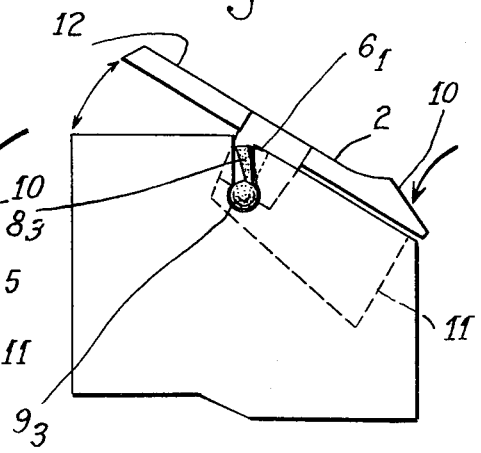
FIG. 5 is a view similar to FIG. 3 but showing a second embodiment of the invention.

A second embodiment of the invention is shown in FIG. 5. In this second embodiment, if the walls of the casing are not sufficiently resiliently deformable, it is possible to make the cover 2 or at least the lugs $8_3$ thereof, of a resilient material, and preferably also the bosses $9_3$ thereof. In this embodiment, when swinging the cover 2 by means of the finger piece 10, the lugs $8_3$, and possibly also the bosses $9_3$, are resiliently deformed sufficiently to permit this deformation and at the same time at least partly to remain in their respective slots and enlargements. Again, when the cover is released, the parts resume their undeformed position with the lugs $8_3$ fully seated in the associated slots. FIG. 5 thus illustrated the obvious alternative to FIGS. 1–4, in which it is the lugs that are resiliently deformable rather than the side walls of the slots.

Of course, in an unillustrated third embodiment, both the lugs and the side walls of the slots could be resiliently deformable.

As will be obvious to those skilled in this art, the cover and receptacle are assembled together by pressing the cover down from the FIG. 1 position to the FIG. 2 position, whereupon the resiliency of the lugs and/or side walls of the slots is sufficient to enable the parts to assemble with a snap action. The cover can similarly be removed in the opposite direction for cleaning and/or replenishing the contents of the receptacle.

From a consideration of the foregoing disclosure, therefore, it will be evident that the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. A pouring receptacle comprising a casing, a cover swingably mounted on said casing, the material of one of the cover and casing being resiliently deformable whereby swinging movement of the cover on the casing to open position resiliently deforms said material, the deformed material resiliently urging the cover toward closed position, the casing opening upwardly and having diametrically opposed slots adjacent its upper end, the cover having diametrically opposed lugs that rest in said slots in the closed position of the cover, whereby upon swinging movement of the cover to open position, said material is resiliently deformed by pressure of the lugs against the side walls of the slots.

2. A pouring receptacle as claimed in claim 1, in which the side walls of the slots are resiliently deformable and the lugs deform the side walls of the slots upon swinging movement of the cover.

3. A pouring receptacle as claimed in claim 1, in which the lugs are resiliently deformable and the side walls of the slots resiliently deform the lugs upon swinging movement of the cover.

4. A pouring receptacle as claimed in claim 1, and enlargements at one end of the slots, and bosses on the cover that fit resiliently in said enlargements to provide a hinge for vertical swinging movement of the cover on the casing.

5. A pouring receptacle as claimed in claim 4, the slots opening upwardly through the upper edge of the casing and the enlargements being disposed at the lower ends of the slots.

6. A pouring receptacle as claimed in claim 5, the lugs being vertically elongated and upright in the closed position of the cover, the bosses being disposed at the lower ends of the lugs.

7. A pouring receptacle as claimed in claim 1, and a finger piece on the cover on which the user presses to open the cover.

8. A pouring receptacle as claimed in claim 1, the cover overlapping the upper edge of the casing, the forward portion of the cover bearing on the forward portion of the upper edge of the casing in the closed position of the cover and the rear portion of the cover bearing on the rear portion of the upper edge of the casing in the open position of the container.

9. A pouring receptacle comprising a casing, a cover swingably mounted on said casing, the material of one of the cover and casing being resiliently deformable whereby swinging movement of the cover on the casing to open position resiliently deforms said material, the deformed material resiliently urging the cover toward closed position, the casing having front and rear upper edges disposed at an oblique angle to each other, the forward portion of the cover engaging the upper edge of the front portion of the container in the closed position of the cover and the rear portion of the cover engaging the upper edge of the rear portion of the casing in the open position of the cover, and a skirt that depends downwardly from the rear portion of the cover and that closes the upper end of the casing in the closed position of the cover.

* * * * *